US012392151B2

(12) United States Patent
Liao

(10) Patent No.: US 12,392,151 B2
(45) Date of Patent: Aug. 19, 2025

(54) WATERPROOF COVER FOR OUTDOOR PRODUCTS

(71) Applicant: Shenzhen Beiyuan Electronic Technology Co., Ltd, Guangdong (CN)

(72) Inventor: Yunlong Liao, Guangdong (CN)

(73) Assignee: Shenzhen Beiyuan Electronic Technology Co., Ltd, Shenzhen (CN)

( * ) Notice: Subject to any disclaimer, the term of this patent is extended or adjusted under 35 U.S.C. 154(b) by 182 days.

(21) Appl. No.: 18/221,434

(22) Filed: Jul. 13, 2023

(65) Prior Publication Data

US 2024/0384560 A1 Nov. 21, 2024

(30) Foreign Application Priority Data

May 15, 2023 (CN) ..... 202321177224.0

(51) Int. Cl.

| | |
|---|---|
| ***E04H 4/10*** | (2006.01) |
| ***E04H 15/02*** | (2006.01) |
| ***E04H 15/34*** | (2006.01) |
| ***E04H 15/40*** | (2006.01) |
| ***E04H 15/54*** | (2006.01) |
| ***E04H 15/64*** | (2006.01) |

(52) U.S. Cl.

CPC ..... *E04H 4/10* (2013.01); *E04H 15/02* (2013.01); *E04H 15/34* (2013.01); *E04H 15/40* (2013.01); *E04H 15/54* (2013.01); *E04H 15/64* (2013.01); *Y10S 52/12* (2013.01); *Y10S 135/907* (2013.01)

(58) Field of Classification Search

CPC ..... E04H 4/10; E04H 15/02; E04H 15/34; E04H 15/40; E04H 15/54; E04H 15/64; Y10S 52/12; Y10S 135/907

USPC ..... 52/3, 5, 23, DIG. 12, DIG. 14; 150/158; 4/498; 108/90; 297/219.1

See application file for complete search history.

(56) References Cited

U.S. PATENT DOCUMENTS

| | | | | |
|---|---|---|---|---|
| 5,259,077 | A * | 11/1993 | Hager | E04H 4/10 135/142 |
| 9,320,353 | B1 * | 4/2016 | Elze | A47C 31/113 |
| 12,046,978 | B2 * | 7/2024 | Chen | H02K 5/04 |
| 2004/0099301 | A1 * | 5/2004 | Zhang | E04H 15/28 5/97 |
| 2005/0072055 | A1 * | 4/2005 | Martin | E04H 4/108 52/3 |
| 2005/0108817 | A1 * | 5/2005 | Wilson | E04H 4/108 4/498 |
| 2019/0078333 | A1 * | 3/2019 | Wing | E04D 5/142 |
| 2023/0345903 | A1 * | 11/2023 | Thompson | A01K 1/033 |

* cited by examiner

*Primary Examiner* — Robert Canfield

(57) ABSTRACT

A waterproof cover for outdoor products comprising having a tarpaulin, a plurality of binding straps, a tensioning assembly, and a support column assembly is disclosed. The tarpaulin comprises a ceiling part composed of flexible materials. The plurality of binding straps are used for fixing to outdoor products. The edge of the tensioning assembly is fastened to the edge of the inner surface of the ceiling part. The top end of the support column assembly is fastened to the inner surface of the center of the ceiling part, the bottom end of the support column assembly is fixed at the center of the tensioning assembly. Through fixing the flexible binding belts to an outdoor product, the flexible tension assembly is tensioned, and the roof of the tarpaulin is jacked up to form a slope, thus avoiding water accumulation in the roof of the waterproof cover.

11 Claims, 6 Drawing Sheets

WATERPROOF COVER FOR OUTDOOR PRODUCTS

CROSS REFERENCE TO RELATED APPLICATIONS

The present application claims the benefit of Chinese Patent Application No. 202321177224.0 filed on May 15, 2023, the contents of which are incorporated herein by reference in their entirety.

TECHNICAL FIELD

The present invention relates to the field of outdoor protective equipment, and more specifically, to a waterproof cover for outdoor products.

BACKGROUND

With the improvement of living standards, people are no longer satisfied with indoor activities. More and more families are starting to have outdoor products placed outdoors, such as outdoor tables, pet pens, etc. These outdoor products are prone to contamination or damage due to the effects of fog or rain when left outdoors for a long time.

To protect outdoor products, a tarpaulin can be placed on them. However, when the tarpaulin is directly applied to outdoor products, it can easily form water accumulation. Prolonged accumulation of water can easily leak, thereby affecting the protection effect.

In addition, there are ways to use inflatable mats combined with tarpaulin to protect outdoor products. However, the above-mentioned inflatable mats require high sealing requirements for production, otherwise they are prone to air leakage. The above-mentioned inflatable mats also have relatively high costs. At the same time, the inflatable cushion needs to be inflated, which is much troublesome to use. Moreover, it requires a flat or grid surface on the top of outdoor product to place the above-mentioned inflatable cushion, which limits the application scope of the aforementioned waterproof protection scheme.

SUMMARY

The main objective of the invention is to provide a waterproof cover for outdoor products that is to solve problems for water accumulation when using a tarpaulin alone and high cost, inconvenient use, and limited application occasions when using an inflatable pad combined with a piece of tarpaulin.

According to an aspect, a waterproof cover for outdoor products is provided, which comprising:

a tarpaulin having a ceiling part made of flexible materials, wherein the center of the ceiling part is convex;

a plurality of binding straps made of flexible materials and used for fastening to outdoor products, wherein one end of each binding strap fastened to the edge of the ceiling part of the tarpaulin;

a tensioning assembly, wherein the tensioning assembly is composed of flexible materials, the edge of the tensioning assembly is fastened to the edge of the inner surface of the ceiling part, and the tensioning assembly is tensioned when the binding straps are respectively tied to outdoor product;

a support column assembly, wherein the top end of the support column assembly is fastened to the inner surface of the center of the ceiling part, the bottom end of the support column assembly is fastened to the center of the tensioning assembly, and the support column assembly jacks up the center of the ceiling part under the action of the tensioning assembly and makes the ceiling part form a tensioned slope above the outdoor product when the tensioning assembly is in a tensioning state.

Advantageously, the tensioning assembly includes at least two tensioning belts, each end of each tensioning belt is fastened to a binding strap, all tensioning belts intersect at the center of the tensioning assembly, and the bottom end of the support column assembly is fastened to the intersection position of the tensioning belts.

Advantageously, the ceiling part includes a plurality of first crest lines, the plurality of first crest lines are radially distributed from the center of the ceiling part, and the vertical projections of the plurality of first crest lines on the plane where the tensioning assembly is located are respectively located on the tensioning belts, and the ceiling part is tensioned above the outdoor product by the tensioning assembly, the support column assembly and the first crest lines.

Advantageously, the tension assembly includes a tensioning fabric, the shape and size of the tensioning fabric match with the shape and size of vertical projection of the ceiling part on the plane where the tensioning fabric is located, the edge of the tensioning fabric is fastened to the edge of the inner surface of the ceiling part, and the bottom end of the support column assembly is fastened to the center of the tensioning fabric.

Advantageously, the tensioning assembly includes a tensioning fabric and at least two tensioning belts, each end of each tensioning belt is fastened to a binding belt, and all tensioning belts intersect at the center of the tensioning assembly, the shape and size of the tensioning fabric match with the shape and size of vertical projection of the ceiling part on the plane where the tensioning fabric is located, and the edge of the tensioning fabric is fastened to the edge of the inner surface of the ceiling part.

Advantageously, the ceiling part includes a plurality of first crest lines, the plurality of first crest lines are radially distributed from the center of the ceiling part, and the vertical projections of the plurality of first crest lines on the plane where the tensioning assembly is located are respectively located on the tensioning belts, and the ceiling part is tensioned above the outdoor product by the tensioning assembly, the support column assembly and the first crest lines.

Advantageously, the outdoor product is a square table, a square fence, or a square cart;

the waterproof cover includes at least two pairs of binding straps, and the fixed positions of the binding straps at the ceiling part are corresponding to the corners of the square table, square fence or square cart, respectively; the plurality of first crest lines extend from the center of the ceiling part to the corner of the square table, square fence or square cart, and the plurality of first crest lines separate the ceiling part to a plurality of slopes when the ceiling part is jacked up by the support column assembly.

Advantageously, the tarpaulin comprises edge parts connected to the edge of the ceiling part, and a plurality of second crest lines are formed at the junction of edge parts and the edge of the ceiling part;

the length of each binding strip is greater than the height of the edge part, and at least a portion of the binding strip is fastened to the edge part.

Advantageously, all tensioning belts are overlapping together in a width direction at the intersection of all tensioning belts.

Advantageously, the support column assembly includes a support rod made of rigid material and a sleeve made of flexible material, the length of the sleeve is greater than the length of the support rod, the sleeve wraps the support rod, and the top end of the sleeve is fastened to the center of the inner surface of the ceiling part, and the bottom end of the sleeve is fastened to the center of the tensioning assembly.

Advantageously, the two binding straps in each pair correspond to the phase angle of one tensioning straps of the tensioning assembly.

The waterproof cover for outdoor products disclosed in the present disclosure has following beneficial effect. Through fixing the flexible binding belts to an outdoor product, the flexible tension assembly is tensioned, and the roof of the tarpaulin is jacked up to form a slope by the tension assembly and support column assembly, thus avoiding water accumulation in the roof of the waterproof cover.

DETAILED DESCRIPTION OF THE PREFERRED EMBODIMENT

To make the object, the technical solution, and the advantage of the present disclosure more clearly, the present disclosure is further described in detail below with reference to the accompanying embodiments. It should be understood that the specific embodiments described herein are just a part of rather than all the embodiments of the present disclosure. All other embodiments obtained by one skilled in the art without inventive works based on the embodiment of the present disclosure, fall into the protection scope of the present disclosure.

Figure 1:
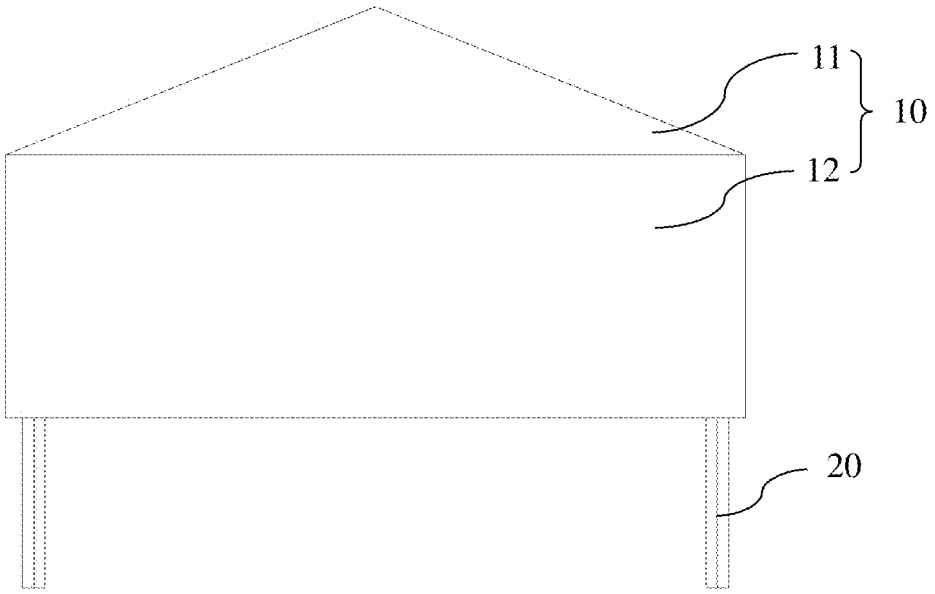
FIG. 1 is a schematic diagram of the waterproof cover for outdoor products according to an embodiment of the present disclosure.
Figure 2:
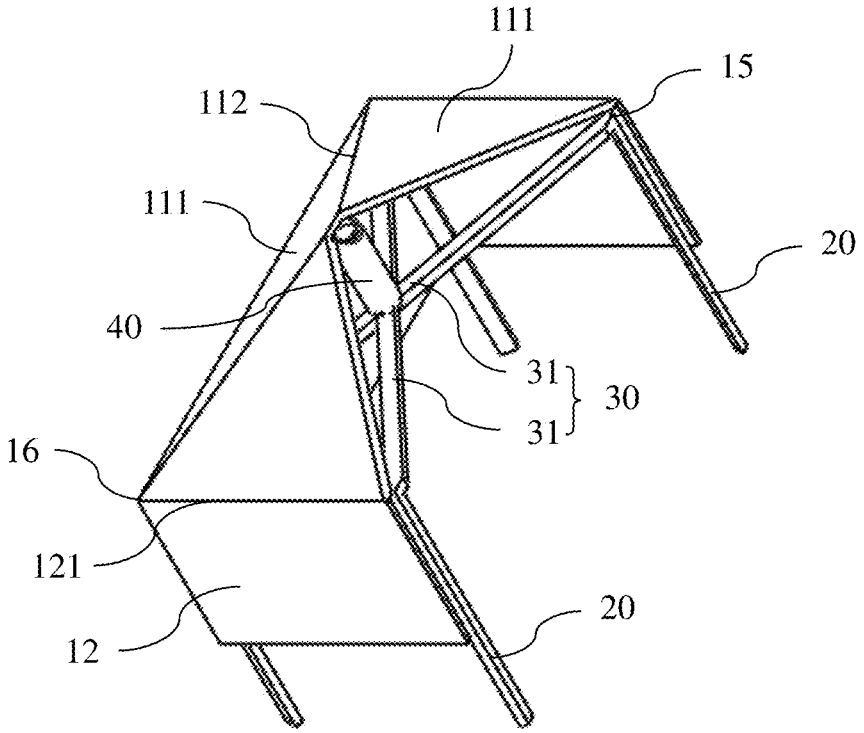
FIG. 2 is a schematic diagram of the inner side of the waterproof cover for outdoor products according to an embodiment of the present disclosure.
Figure 3:
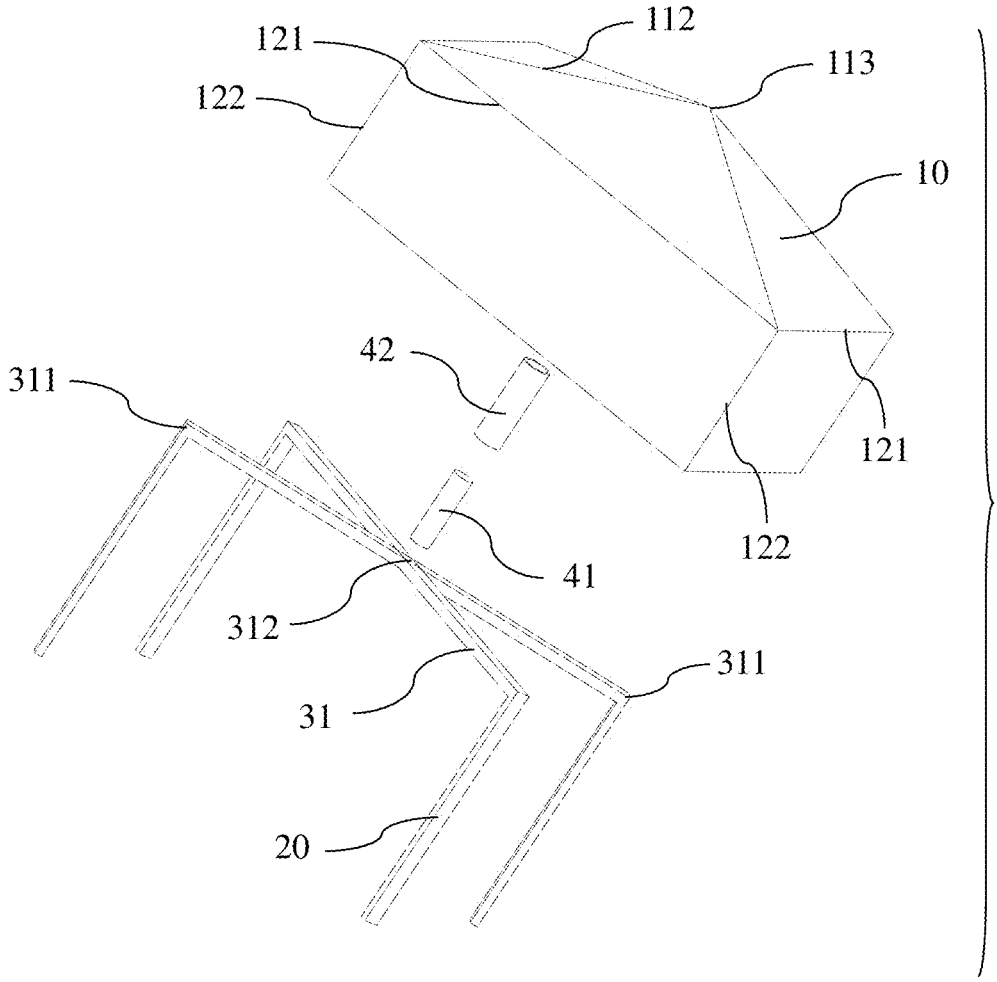
FIG. 3 is a decomposition diagram of the waterproof cover for outdoor products according to an embodiment of the present disclosure.

FIGS. 1 to 3 show the structure of the waterproof cover for outdoor products according to an embodiment of the present disclosure. The waterproof cover for outdoor products as shown in FIGS. 1-3 can be placed on an outdoor product to prevent the outdoor product from being affected by rain and affecting its lifespan. The outdoor waterproof cover for outdoor products according to the present embodiment includes a tarpaulin 10, a tensioning assembly 30, a support column assembly 40, and four binding straps 20. The four binding straps 20 are divided into two pairs that are diagonally distributed. The support column assembly 40 and four binding straps 20 are respectively fastened to the tarpaulin 10. The tarpaulin 10 is fastened to outdoor products by four binding straps 20. In other embodiments, the number of binding straps 20 can be different, for example, the number of binding straps 20 can be three, five, six, etc.

The tarpaulin 10 is made of materials with good waterproof performance and good flexibility. For example, the tarpaulin 10 can be composite fabrics which composed of polymer waterproof, breathable materials and fabrics. The tarpaulin 10 includes a ceiling part 11. The ceiling part 11 is not planar, and the center 113 of the ceiling part 11 is convex. Of course, in other embodiments, a sun protection layer can also be made on the surface of the tarpaulin 10 to improve its sun protection performance.

Each binding strap 20 is made of flexible materials and is used to fasten to outdoor products. For example, the binding strap 20 can be made of fiber fabric, and one end of each binding strap 20 is fastened to the edge of the ceiling part 11. Specifically, the fixing points of multiple binding straps 20 and the ceiling part 11 can be located at the multiple vertices of the same rectangle or polygon to improve the stability of the fixation of the ceiling part 11. The tensioning assembly 30 is made of flexible materials. The edge of the tensioning assembly 30 is fastened to the edge of the inner surface of the ceiling part 11. The tensioning assembly 30 is tensioned when the binding straps 20 are respectively tied to the outdoor product. The length of each binding strap 20 is enough to be fastened to the outdoor product. In addition, the free end of each binding strap 20 can also be provided with a Velcro, an elastic rope, a hook, etc., so as to facilitate fasten to the outdoor product.

The support column assembly 40 is roughly columnar in shape and is rigidity in axial. The top end of the support column assembly 40 is fastened to the inner surface of the center of the ceiling part 11 of the tarpaulin 10, and the bottom end of the support column assembly 40 is fastened to the center of the tensioning assembly 30. When the support column assembly 40 is in a tensioned state, the center of the ceiling part 11 is jacked up and the ceiling part 11 forms a tensioned slope 111 above the outdoor product by the support force provided by the tensioning assembly 40.

The waterproof cover described above is fastened to the outdoor product by fastening the binding straps 20 to the outdoor product. When the tensioning assembly 30 is tensioned, the center of the ceiling part 11 of the tarpaulin 10 is jacked up by the tensioning assembly 30 and the support column assembly 40, and the ceiling part 11 forms one or more slopes 111. Therefore, raindrops that fall on the ceiling part 11 can flow downward along the slope 111 under the action of gravity, avoiding water accumulation in the ceiling part 11 of the tarpaulin 10. Due to the lack of a rigid support rod at the edge of the ceiling part 11 and the fact that there is only one support column assembly 40 with a smaller size in axial, the waterproof cover can be conveniently folded and stored when not in use. People just bind the binding straps 20 to the outdoor product when using the waterproof cover, and need not to build a support frame.

As shown in FIG. 3, the tensioning assembly 30 includes at least two tensioning belts 31 in an embodiment of the present disclosure. Two ends 311 of each tensioning belt 31 are respectively fastened to the edges 15, 16 of the ceiling part 11, and all tensioning belts 31 intersect at the center 312 of the tensioning assembly 30. The bottom end of the support column assembly 40 is fastened to the intersection position of all tensioning belts 31. When fastening the binding straps 20 to the outdoor product, the tensioning belts 31 are tensioned (i.e. the tensioning belts 31 is straightened) and can provide upward support. The number of tensioning belts 31 can be increased when the size of the ceiling part 11 is large, thus the support force on the support column component 40 can be increased, for ensuring that the ceiling part 11 forms the slopes 111.

Specifically, the two binding straps 20 in each pair of binding straps correspond to the phase angle of one tensioning belt 31 of the tensioning assembly 30. For example, the two ends 311 of each tensioning belt 31 are respectively fixed or integrated with one binding strap 20.

In one embodiment of the present disclosure, the cross-sectional area of the tensioning belts 31 of the tensioning assembly 30 is flat in order to support the support column assembly 40 better. All tensioning belts 31 are fastened together in a width direction overlap at the intersection position 312, thereby providing a larger support area for the bottom end of the support column assembly 40. The above structure is suitable for situations where the size of the ceiling part 11 is small, such as rainproof for smaller tables, carts, etc.

Specifically, the tensioning belts 31 can be made of fiber fabric, which ensures structural strength while facilitating storage. In addition, both ends of each tension belt 31 can be directly sewn on the edge of the ceiling part 11. In other embodiments, both ends of the tensioning belt 31 can also be fastened to the ceiling part 11 by means of Velcros, metal buckles, etc.

Figure 4:
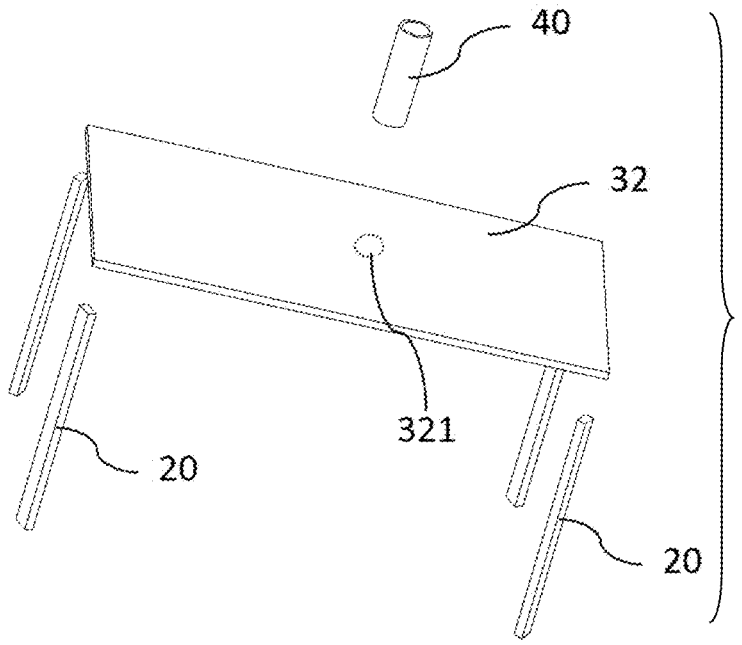
FIG. 4 is a decomposition diagram of the tensioning assembly and the binding straps of the waterproof cover for outdoor products according to another embodiment of the present disclosure.

As shown in FIG. 4, in another embodiment of the present disclosure, the tensioning assembly 30 includes a tensioning fabric 32. The shape and size of the tensioning fabric 32 matches the shape and size of vertical projection of the ceiling part 11. The edge of the tensioning fabric 32 is fastened to the edge of the inner surface of the ceiling part 11. The bottom end of the support column assembly 40 is fixed at the center 321 of the tensioning fabric 32. The above structure is suitable for situations where the size of ceiling part is small, such as rainproof for smaller pet fences. Due to the overall structure of the tensioning fabric 32, it can prevent pets inside the pet fence from biting the tension belt, compared to the embodiment in FIG. 3.

Specifically, the tensioning fabric 32 can be made of fiber fabric, which ensures structural strength while facilitating storage. In addition, the edge of the tensioning fabric 32 can be directly sewn on the edge of the ceiling part 11. In other embodiments, the edge of the tensioning fabric 32 can also be fastened to the ceiling part 11 by means of Velcros, metal buckles, etc.

Figure 5:
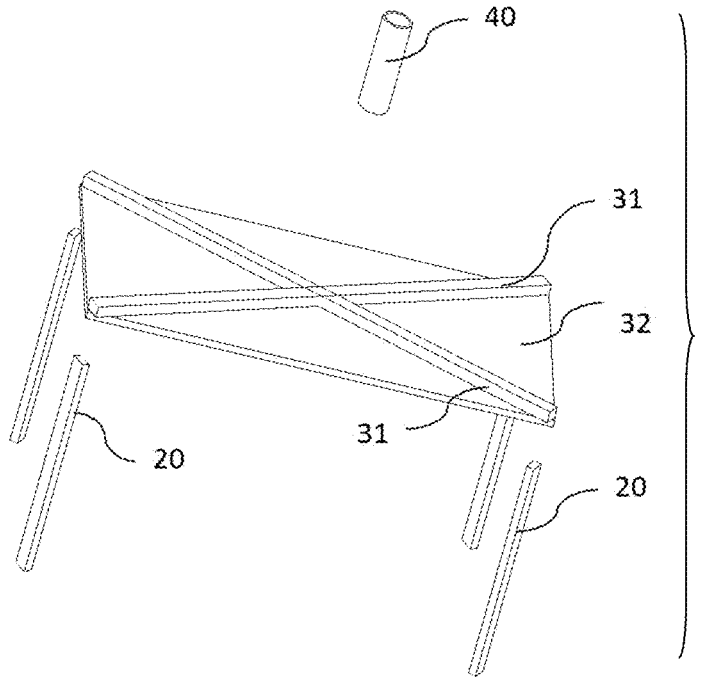
FIG. 5 is a decomposition diagram of the tensioning assembly and the binding straps of the waterproof cover for outdoor products according to another embodiment of the present disclosure.

As shown in FIG. 5, in another embodiment of the present disclosure, the tensioning assembly 30 includes both a tensioning fabric 32 and at least two tensioning belts 31. The shape and size of the tensioning fabric 32 are matched with the vertical projection of the ceiling part 11. The edge of the tensioning fabric 32 is fastened to the edge of the inner surface of the ceiling part 11. The tensioning belts 31 can be fastened to the upper surface or the lower surface of the tensioning fabric 32, and all tensioning belts 31 intersect at the center of the tensioning fabric 32. This structure is suitable for situations where the ceiling part 11 is larger in size, such as rainproof for larger tables, larger pet fences, etc.

In order to improve structural stability, in one embodiment of the present disclose, the ceiling part 11 comprises a plurality of first crest lines 112 when the tensioning assembly 30 includes the tensioning belts 31. The plurality of first crest lines 112 are radially distributed from the center of the ceiling part 11. The top end of the support column assembly 40 is fixed at the intersection of the plurality of first crest lines 112. Vertical projections of all first crest lines 112 on the plane of the tensioning assembly 30 are respectively located on the tensioning belts 31. The ceiling part 11 is tensioned above the outdoor product by the tensioning assembly 30, the support column assembly 40, and the first crest lines 112.

When the waterproof cover is covered on the outdoor table or other outdoor products that need rain or dust prevention, the tensioning belts 31, the first crest lines 112 and the support column assembly 40 form a plurality of stable triangle as the binding belt 20 is respectively tied with the outdoor products. Thus, the three-dimensional space of the ceiling part 11 is relatively stable, and the support column assembly 40 will not be significantly skewed. The support column assembly 40 can lift the ceiling part 11. Accordingly, the ceiling part 11 can be formed by splicing multiple waterproof cloth. Each first crest line 112 is located at the splicing position of adjacent waterproof cloth. In addition, the first crest lines 112 can also be formed by sewing lines at predetermined positions on the ceiling part 11.

Figure 6:
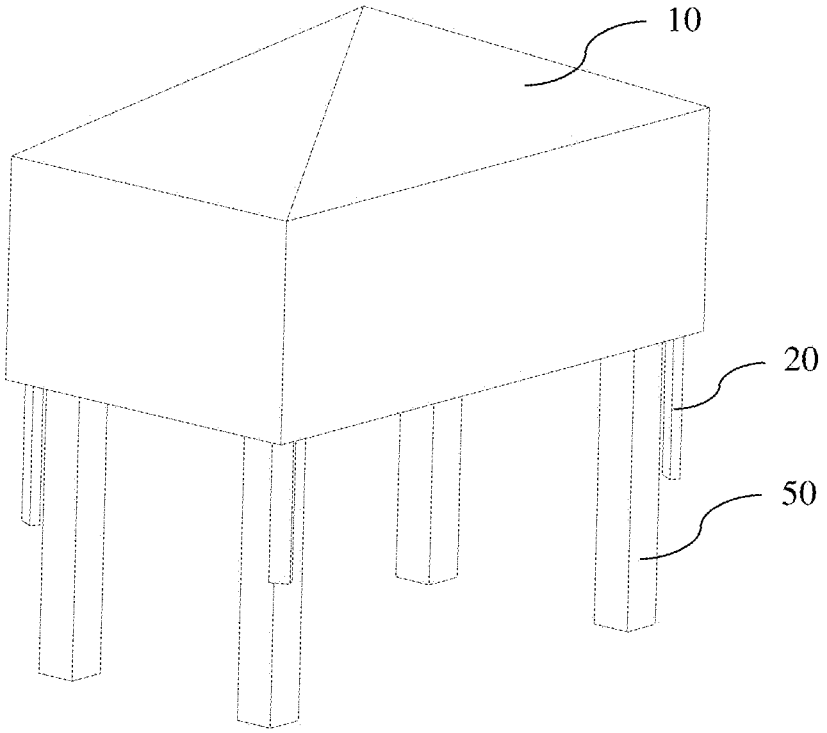
FIG. 6 is a schematic diagram of the waterproof cover for outdoor products applied to a square table according to an embodiment of the present disclosure.

As shown in FIG. 6, in one embodiment of the present disclosure, a waterproof cover for a square table 50 is provided, and the tensioning assembly 30 of the above waterproof cover includes two pairs of binding straps 20 and two tensioning belts 31. The fixed positions of the two pairs of binding straps 20 and two tensioning belts 31 with the ceiling part 11 are located on the four corners of the square table 50. Accordingly, the ceiling part 11 includes four first crest lines 112 extending from the center of the ceiling part 11 to the four corners of the square table 50. When the ceiling part 11 is covered on the surface of the square table 50, the binding straps 20 can be bound to the legs of the square table 50. At this time, the tensioning belts 31 are tensioned on the surface of the square table 50, the bottom end of the support column assembly 40 is against the surface of the square table 50 to jack up the center of the ceiling part 11, and four first crest lines 112 separate the ceiling part 11 to form four slopes 111.

Figure 7:
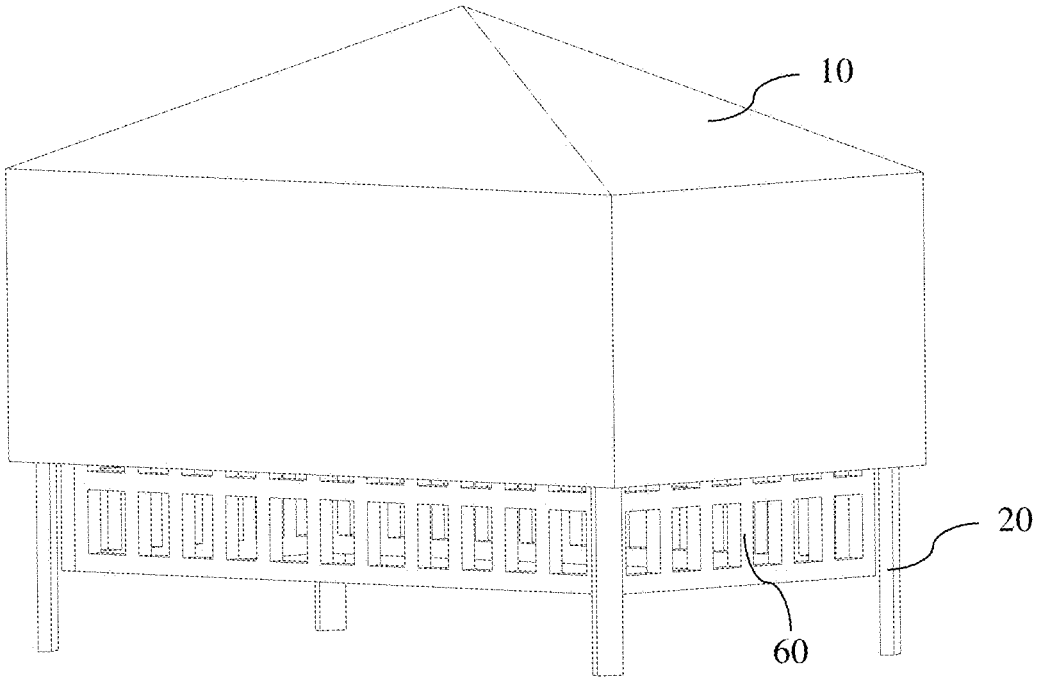
FIG. 7 is a schematic diagram of the waterproof cover for outdoor products applied to a square fence according to an embodiment of the present disclosure.

As shown in FIG. 7, in another embodiment of the present disclosure, a waterproof cover for a square fence 60 without a top cover (such as a pet fence) is provided, and the above waterproof cover includes two pairs of binding straps 20 and a tensioning fabric 32. The fixed positions of the two pairs of binding straps 20 with the ceiling part 11 are located on the four corners of the square fence 60 respectively. Accordingly, the ceiling part 11 includes four first crest lines 112 extending from the center of the ceiling part 11 to the four corners of the square fence 50. When the ceiling part 11 is covered on the square fence 50, the binding strips 20 can be bound to the grid or column of the square fence 50. At this time, the tensioning fabric 32 is suspended above the square fence 50 and tensioned. The bottom end of the support column assembly 40 lifts the center of the ceiling part 11 under the support of the tensioning fabric 32 and separates the ceiling part 11 into four slopes 111 by four first crest lines 112.

The waterproof cover mentioned above can also be used for round tables, circular fences, etc. Correspondingly, its ceiling part 11 is circular. At this time, the edge of the ceiling part 11 can be fastened to three or more binding straps. In addition, the technicians in this field can understand that the waterproof covers can also be applied to other shapes of outdoor products, and will not be elaborated here.

In one embodiment of the present disclosure, the tarpaulin 10 not only includes the ceiling part 11, but also includes edge parts 12 which are connected to the edge of the ceiling part 11. A second crest lines 121 is formed at the junction of each edge part 12 and the edge of the ceiling part 11. By the edge parts 12, outdoor products can be better protected while preventing the ceiling part 11 from being blown up by the wind. The second crest lines 121 are conducive to the positioning of the tarpaulin 10, that is, the ceiling part 11 can fully cover the outdoor products by attaching the second crest lines 121 to the edges of the outdoor products. The second crest lines 121 can be specifically composed of a suture line between the ceiling part 11 and the edge part 12. In other embodiments, the second crest lines 121 is a transitional part between the ceiling part 11 and the edge part 12.

In one embodiment of the present disclosure, when the waterproof cover is for a square table, square fence, or square cart, the tarpaulin 10 includes four edge parts 12, which correspond to the four sides of the square table, square fence, or square cart. A third crest line 122 is formed between adjacent edge parts 12. Similarly, the third crest line 122 mentioned above can be a transitional part of the two edge parts 12.

In order to protect outdoor products better, the length of each binding strap 20 in the waterproof cover is greater than the height of the edge part 12, and at least a part of the binding strap 20 is fastened to the edge part 12. By the above structure, the edge parts 12 can be tightly attached to the outdoor product to prevent the tarpaulin 10 from being blown up by the wind when the binding straps 20 are fastened to the outdoor product.

In one embodiment of the present disclosure, the support column assembly 40 includes a support rod 41 made of rigid materials (such as metal or hard plastic) and a sleeve 42 made of flexible materials (such as fiber fabric). The support rod 41 is wrapped by the sleeve 42. The top end of the sleeve 42 is fixed (such as sewing) at the center of the inner surface of the ceiling part 11. The bottom end of the sleeve 42 is fixed (such as sewing) at the center of the tensioning assembly 30.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

The invention claimed is:

1. A waterproof cover for outdoor products comprising:

a tarpaulin having a ceiling part made of flexible materials, wherein the center of the ceiling part is convex;

a plurality of binding straps made of flexible materials and used for fastening to outdoor products, wherein one end of each binding strap fastened to the edge of the ceiling part of the tarpaulin;

a tensioning assembly, wherein the tensioning assembly is composed of flexible materials, the edge of the tensioning assembly is fastened to the edge of the inner surface of the ceiling part, and the tensioning assembly is tensioned when the binding straps are respectively tied to an outdoor product;

a support column assembly, wherein the top end of the support column assembly is fastened to the inner surface of the center of the ceiling part, the bottom end of the support column assembly is fastened to the center of the tensioning assembly, and the support column assembly jacks up the center of the ceiling part under the action of the tensioning assembly and makes the ceiling part form a tensioned slope above the outdoor product when the tensioning assembly is in a tensioning state.

2. The waterproof cover for outdoor products as claimed in claim 1, wherein the tensioning assembly includes at least two tensioning belts, each end of each tensioning belt is fastened to a binding strap, all tensioning belts intersect at the center of the tensioning assembly, and the bottom end of the support column assembly is fastened to the intersection position of the tensioning belts.

3. The waterproof cover for outdoor products as claimed in claim 2, wherein the ceiling part includes a plurality of first crest lines, the plurality of first crest lines are radially distributed from the center of the ceiling part, and the vertical projections of the plurality of first crest lines on the plane where the tensioning assembly is located are respectively located on the tensioning belts, and the ceiling part is tensioned above the outdoor product by the tensioning assembly, the support column assembly and the first crest lines.

4. The waterproof cover for outdoor products as claimed in claim 2, wherein all tensioning belts are overlapping together in a width direction at the intersection of all tensioning belts.

5. The waterproof cover for outdoor products as claimed in claim 1, wherein the tension assembly includes a tensioning fabric, the shape and size of the tensioning fabric match with the shape and size of vertical projection of the ceiling part on the plane where the tensioning fabric is located, the edge of the tensioning fabric is fastened to the edge of the inner surface of the ceiling part, and the bottom end of the support column assembly is fastened to the center of the tensioning fabric.

6. The waterproof cover for outdoor products as claimed in claim 1, wherein the tensioning assembly includes a tensioning fabric and at least two tensioning belts, each end of each tensioning belt is fastened to a binding belt, and all tensioning belts intersect at the center of the tensioning assembly, the shape and size of the tensioning fabric match with the shape and size of vertical projection of the ceiling part on the plane where the tensioning fabric is located, and the edge of the tensioning fabric is fastened to the edge of the inner surface of the ceiling part.

7. The waterproof cover for outdoor products as claimed in claim 6, wherein the ceiling part includes a plurality of first crest lines, the plurality of first crest lines are radially distributed from the center of the ceiling part, and the vertical projections of the plurality of first crest lines on the plane where the tensioning assembly is located are respectively located on the tensioning belts, and the ceiling part is tensioned above the outdoor product by the tensioning assembly, the support column assembly and the first crest lines.

8. The waterproof cover for outdoor products as claimed in claim 7, wherein the outdoor product is a square table, a square fence, or a square cart;

the waterproof cover includes at least two pairs of binding straps, and the fixed positions of the binding straps at the ceiling part are corresponding to the corners of the square table, square fence or square cart, respectively;

the plurality of first crest lines extend from the center of the ceiling part to the corner of the square table, square fence or square cart, and the plurality of first crest lines separate the ceiling part to a plurality of slopes when the ceiling part is jacked up by the support column assembly.

9. The waterproof cover for outdoor products as claimed in claim 6, wherein all tensioning belts are overlapping together in a width direction at the intersection of all tensioning belts.

10. The waterproof cover for outdoor products as claimed in claim 1, wherein the tarpaulin comprises edge parts connected to the edge of the ceiling part, and a plurality of second crest lines are formed at the junction of edge parts and the edge of the ceiling part;

the length of each binding strip is greater than the height of the edge part, and at least a portion of each respective binding strip is fastened to the edge part.

11. The waterproof cover for outdoor products as claimed in claim 1, wherein the support column assembly includes a support rod made of rigid material and a sleeve made of flexible material, the length of the sleeve is greater than the length of the support rod, the sleeve wraps the support rod, and the top end of the sleeve is fixed at the center of the inner surface of the ceiling part, and the bottom end of the sleeve is fixed at the center of the tensioning assembly.

* * * * *